US006035241A

United States Patent [19]

Yamamoto

[11] Patent Number: 6,035,241

[45] Date of Patent: Mar. 7, 2000

[54] CONTROL DEVICE FOR BULLDOZER BLADE AND ITS CONTROL METHOD

[75] Inventor: Shigeru Yamamoto, Hirakata, Japan

[73] Assignee: Komatsu Ltd., Tokyo, Japan

[21] Appl. No.: 08/913,734

[22] PCT Filed: Mar. 22, 1996

[86] PCT No.: PCT/JP96/00749

§ 371 Date: Sep. 23, 1997

§ 102(e) Date: Sep. 23, 1997

[87] PCT Pub. No.: WO96/29479

PCT Pub. Date: Sep. 26, 1996

[30] Foreign Application Priority Data

Mar. 23, 1995 [JP] Japan ..... 7-088627

[51] Int. Cl.[7] ..... G05B 13/02

[52] U.S. Cl. ..... 700/40; 172/45

[58] Field of Search ..... 172/4.5, 812; 364/160, 364/474.07

[56] References Cited

U.S. PATENT DOCUMENTS 5,160,239 11/1992 Allen et al. ..... 414/699

5,499,684 3/1996 Stratton ..... 172/4.5

FOREIGN PATENT DOCUMENTS 63-27571 2/1989 Japan .

2-204534 8/1990 Japan .

4-37650 3/1992 Japan .

5-33364 2/1993 Japan .

*Primary Examiner*—William Grant

*Assistant Examiner*—Chad Rapp

*Attorney, Agent, or Firm*—Sidley & Austin

[57] ABSTRACT

A control device and its method by which interference between a blade (10) of a bulldozer and a vehicle body can be prevented even when a pitch back angle of the blade (10) is made large and a tilt speed is increased to greatly change a tilt angle. Therefore, the device comprises left and right detecting means **(20*a*, 20*b*, 23*a*, 23*b*) for detecting an amount of tilt of the blade (10), left and right tilt limiting valves (37, 38) connected to operating units (35*a*, 35*b*) of first and second directional control valves (35, 36), and a controller (50) outputting a command to the left and right tilt limiting valves (37, 38) so as to stop a tilting action of the blade (10) when a difference between amounts of tilt detected by the left and right detecting means (20*a*, 20*b*, 23*a*, 23*b*)** reaches a predetermined limit value.

12 Claims, 7 Drawing Sheets

CONTROL DEVICE FOR BULLDOZER BLADE AND ITS CONTROL METHOD

FIELD OF THE INVENTION

The present invention relates to a control device, for automatically limiting an operation angle into a tilt position for a blade of a bulldozer and for preventing interference between the blade and the vehicle body, and its control method.

BACKGROUND ART

Conventionally, a blade 10 of a bulldozer is removably installed so as to pivot in the forward and backward directions at respective ends of the left and right frames 15A and 15B as shown in FIGS. 6 and 7A to 7C. One end of each of the left and right hydraulic lift cylinders 21A and 21B is removably and pivotably installed at the back of the blade 10 and the other end of each of these cylinders is removably and pivotably installed in a vehicle body 20*x*. The blade 10 is moved upwardly and downwardly by a contraction/expansion driving of the left and right lift cylinders 21A and 21B.

One end of each of the left and right hydraulic pitch cylinders 20A and 20B is removably and pivotably installed at the back of the blade 10 and the other end of each of these cylinders is removably and pivotably installed in a respective one of the frames 15A and 15B. If the left and right pitch cylinders 20A and 20B are simultaneously extended for driving, the blade 10 is put into a pitch dump position (leaning forwardly) for dumping earth and sand. If the left and right pitch cylinders 20A and 20B are simultaneously retracted for driving, the blade 10 is put into a pitch back position (leaning backwardly) for carrying earth and sand. If the blade 10 has a nose angle $\alpha$ of 55 degrees, the blade 10 is in an excavation position for excavating earth and sand.

Furthermore, if the right pitch cylinder 20B is stopped without being supplied with any pressurized oil while only the left pitch cylinder 20A is supplied with pressurized oil for extension, the blade 10 makes a rightward tilting action (the right end of the blade 10 tilts downwardly). On the contrary, if the left pitch cylinder 20A is retracted, the blade 10 makes a leftward tilting action (the left end of the blade 10 tilts downwardly).

A request has been made for increasing the amount of carried earth and sand, by enlarging the pitch back angle of the blade 10, since a bulldozer carries the earth and sand for a long distance in a work of topsoiling, such as a strip mining. Therefore, the blade 10 is made with the maximum pitch back angle of approximately 45 degrees, at which the blade 10 is close to the vehicle body 20*x*.

However, if the blade 10 is operated with a tilting action from a state of the maximum pitch back angle, the blade 10 further approaches the vehicle body 20*x* as shown in FIG. 8, and then it interferes with a radiator guard or the like in front of the vehicle body. This interference easily occurs since the blade 10 exceeds a tilt angle limit value while it is operated at a higher tilt speed. On the other hand, if the blade 10 is operated at a lower tilt speed, it stops before an operator achieves the desired tilt angle, and therefore the operator cannot achieve the desired tilt angle.

As described above, it is hard even for a skilled operator to achieve the optimum control of the tilt speed and the tilt angle with a speedy tilting action. In other words, due to the great inertia force of the blade 10, an operator cannot stop the supplying of the pressurized oil to the left and right pitch cylinders 20A and 20B with a lever control before the blade 10 interferes with the radiator guard or the like. It occurs due to a requirement of approximately 0.5 second for a response due to properties of oil pressure in conventional hydraulic devices.

To solve these problems, frames 15A and 15B are made longer as shown in FIG. 10B so as to achieve a longer distance between the blade 10 and the vehicle body 20*x* of the bulldozer 20, whereby the interference can be prevented.

Assuming that W is a weight of the bulldozer 20, Lw is a distance between the center of an actuating wheel 20*y* and a position of the center of gravity G, and Lf is a distance between the center of the actuating wheel 20*y* and a nose of the blade 10, the following relation is satisfied:

$$F=(Lw/Lf)W$$

This relation, however, suggests a problem in that, if the distance Lf between the center of the actuating wheel 20*y* and the nose of the blade 10 becomes longer, the nose force F of the blade 10 is reduced, which lowers an operation capability. In addition, it makes the length L1 longer for moving the blade 10 rotatably around point pins 15*a* and 15*b* of the frames 15A and 15B, which increases the sensitivity of the movement amount of the blade 10 for the control amount of the operator and therefore it becomes harder to control the blade.

Accordingly, to secure the nose force F of the blade 10, the blade 10 must be put into a position close to the vehicle body 20*x* as shown in FIG. 10A. In the Japanese Non-examined Patent Publication No. 2-204534, this applicant proposed a control device, having functions of tilting and pitching actions of the blade 10, for this type of a bulldozer 20.

To increase the capacity of pressed earth of the blade 10 of the bulldozer 20, it is also required to increase the pitch back angle and the tilt speed. Additionally, in greatly changing the tilt angle of the blade 10, the operator must stop the tilting action so as to prevent the tilt angle of the blade 10 from exceeding the tilt angle limit value. At this point, it is important to determine when the tilting action should be stopped. However, since the tilt angle limit value depends upon the pitch back angle of the blade 10, it is hard for an operator to determine it by himself. To stop the blade 10 so as not to interfere with the radiator guard, the operator must repeat the tilt action many times.

Furthermore, a higher tilt speed of the blade 10 causes the tilt angle to exceed the tilt angle limit value, while a lower tilt speed thereof requires a long time for obtaining a tilt angle desired by the operator, by which it becomes harder to control the blade. This causes a need for expensive devices such as a proportioning control valve or the like.

SUMMARY OF THE INVENTION

The present invention is provided from the viewpoint of the problems set forth above. Therefore, it is an object of the present invention to provide a control device and a method by which interference between a bulldozing blade of a bulldozer and the vehicle body can be prevented by an automatic control of precisely stopping a tilting action of the blade when the tilt angle reaches a predetermined tilt angle limit value even when the pitch back angle of the blade is made large and the tilt speed is increased to greatly change the tilt angle.

In a control device for a blade of a bulldozer, comprising a blade installed pivotably in the forward and backward directions, at respective ends of frames on both sides of the vehicle body, the left and right lift cylinders for controlling the movement of the blade upwardly and downwardly, with one end removably installed in the blade and the other end installed in the vehicle body, and the left and right pitch cylinders for controlling the pitch of the blade with pitch dump or pitch back actions via first and second directional control valves and for controlling the tilt of the blade with left and right tilt actions via one of the first and second directional control valves, with one end removably installed in the blade and the other end in respective frames; there are provided left and right detecting means for detecting the amount of tilt of the blade, left and right tilt limiting valves which are connected to operating units of the first and second directional control valves, and a controller for outputting a command to the left and right tilt limiting valves so as to stop a tilting action of the blade when a difference between the amounts of tilt detected by the left and right detecting means reaches a predetermined limit value.

This controller can be equipped with a delay circuit for calculating a correction value used for initiating the stopping of the tilting action a certain period of time before the difference between the amounts of tilt detected by the left and right detecting means reaches the predetermined limit value.

The detecting means for detecting the amounts of tilt of the blade can comprise yoke angle sensors for detecting the rotational angles of the yokes for supporting the left and right lift cylinders or stroke sensors for detecting working strokes of the left and right pitch cylinders.

In a method of the present invention for controlling the bulldozer blade, which comprises controlling the movement of the blade upwardly and downwardly with contraction/expansion driving of the left and right lift cylinders of the vehicle body, controlling the pitch of the blade with pitch dump and pitch back actions by supplying pressurized oil to the left and right pitch cylinders via the first and second directional control valves during expansion driving, and controlling the tilt of the blade with left and right tilting actions by supplying pressurized oil to either of the left and right pitch cylinders via either of the first and second directional control valves during expansion driving; the detecting means detect respective amounts of tilt in the leftward and rightward directions when the blade is tilted leftwardly or rightwardly, and stop the tilting action of the blade based on a command outputted from the controller when a difference between the amounts of leftward and rightward tilt reaches a predetermined limit value.

The command used for initiating the stopping of the tilting action of the blade is outputted from the controller a certain period of time before the difference between the amounts of leftward and rightward tilt reaches the predetermined limit value.

As respective amounts of tilt detected by the left and right detecting means, the respective rotational angles of the yokes for supporting the left and right lift cylinders can be detected and a limit value for a difference between the yoke angles can be calculated based on an average yoke angle of the detected yoke rotational angles. When the difference between the left and right yoke angles reaches the predetermined limit value, the left and right tilt limiting valves, connected to the operating units of the first and second directional control valves, are automatically turned ON so as to stop the tilting action of the blade. Otherwise, the respective working strokes of the left and right pitch cylinders can be detected and a limit value for a difference between the strokes can be calculated based on an average stroke of the detected working strokes. When the difference between the left and right strokes reaches the predetermined limit value, the left and right tilt limiting valves are automatically turned ON so as to stop the tilting action of the blade.

In this configuration, an average amount of tilt is obtained from the amounts of leftward and rightward tilt, detected by the left and right detecting means for detecting an amount of tilt of the blade; and then a limit value for a difference between the amounts of leftward and rightward tilt is calculated from the average amount of tilt based on a predetermined function. Then, it is determined whether or not the difference between the amounts of leftward and rightward tilt is lower than the limit value. If the difference between the amounts of leftward and rightward tilt is equal to or greater than the limit value, a command signal is outputted from the controller so as to automatically turn ON a solenoid of one of the left and right tilt limiting valves. If the difference between the amounts of leftward and rightward tilt is lower than the limit value, a command signal is outputted from the controller so as to automatically turn OFF the solenoid of one of the left and right tilt limiting valves.

Therefore, even when a pitch back angle of the blade of a bulldozer or the like is made large and a tilt speed is increased to greatly change a tilt angle, the tilting action of the blade is automatically controlled so as to stop when the difference between the amounts of leftward and rightward tilt reaches the predetermined tilt limit value, whereby interference between the blade and the vehicle body is prevented, so that an operator can control the blade safely.

In addition, the controller can be equipped with a delay circuit for initiating the stopping of the tilting action a certain period of time before the difference between the amounts of leftward and rightward tilt reaches a predetermined limit value, taking into consideration the response properties of hydraulic devices, whereby a tilting action of the blade can be stopped precisely.

At this point, the amount of tilt of the blade is detected by yoke angle sensors for detecting respective rotation angles of the yokes for supporting the left and right lift cylinders or stroke sensors for detecting respective working strokes of the left and right pitch cylinders.

BEST MODE FOR CARRYING OUT THE INVENTION

A first embodiment of a blade control device for a bulldozer and its control method according to the present invention will be described below with reference to FIGS. 1A to 5.

Figure 1A:
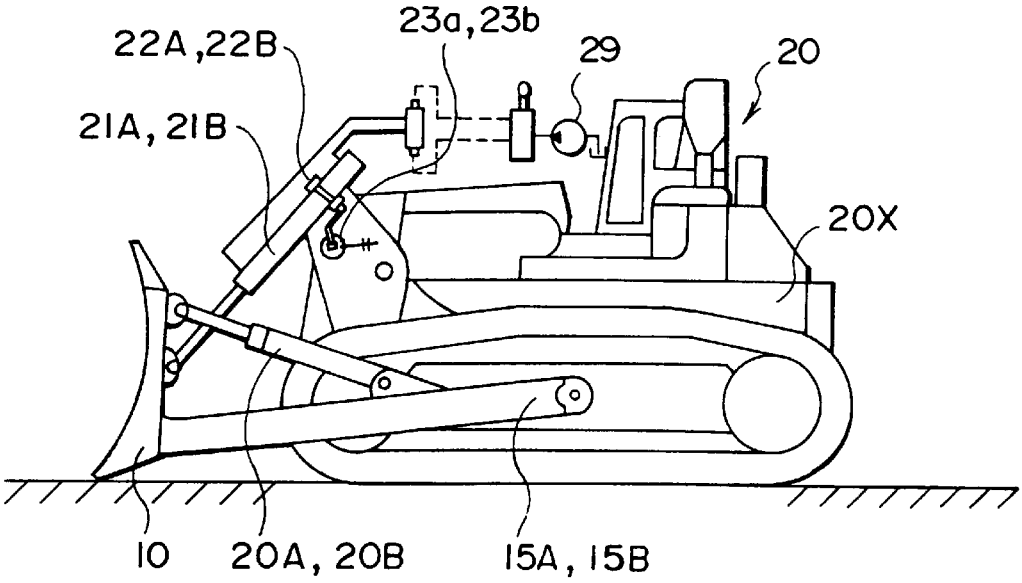
FIG. 1A is a side view of a bulldozer according to a first embodiment of the present invention.
Figure 1B:
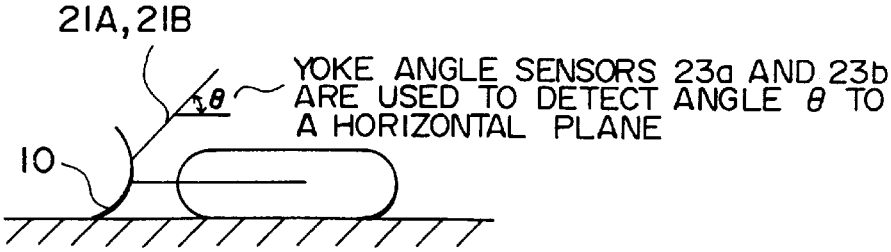
FIG. 1B is a description diagram of a yoke angle sensor shown in FIG. 1A.

Yokes 22A and 22B are rotatably installed on the left and right sides, respectively, of the vehicle body 20*x* of the bulldozer 20 as shown in FIG. 1A. One end of the left hydraulic lift cylinder 21A is fixed to the yoke 22A and the other end is pivotably connected to the left end portion of the blade 10, while one end of the right hydraulic lift cylinder 21B is pivotably connected to the right end portion of the blade 10. Yoke angle sensors 23*a* and 23*b* for detecting the rotational angles of the yokes 22A and 22B, respectively, are installed on the left and right sides of the vehicle body 20*x*. Each of the yoke angle sensors 23*a* and 23*b* is installed so as to detect a yoke angle θ to a horizontal plane as shown in FIG. 1B.

Figure 2:
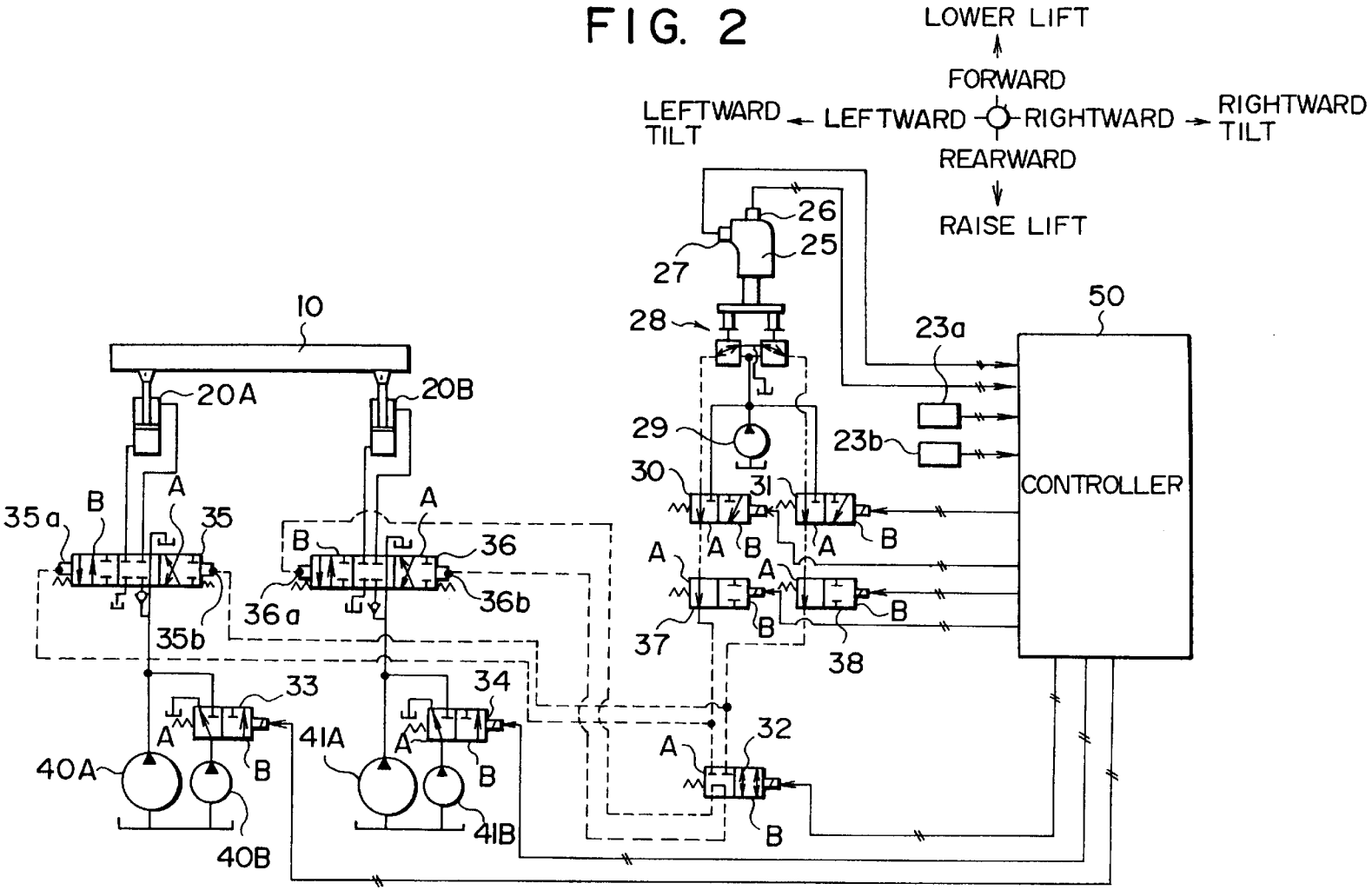
FIG. 2 is a blade control circuit diagram according to the first embodiment.

FIG. 2 shows tilting, pitch dump, and pitch back operation circuits as control circuits of the blade 10. However, a lifting operation circuit is omitted here since it is the same as for the conventional one. A discharge conduit of a hydraulic pump 40A is connected to a first hydraulic pitch cylinder 20A via a first directional control valve 35. A discharge conduit of a hydraulic pump 41A is connected to a second hydraulic pitch cylinder 20B via a second directional control valve 36. The hydraulic pumps 40A and 41A are of a stationary-capacity type, and an outlet circuit of an auxiliary hydraulic pump 40B is connected to an outlet circuit of the hydraulic pump 40A via an auxiliary magnetic valve 33. In addition, an outlet circuit of an auxiliary hydraulic pump 41B is connected to an outlet circuit of the hydraulic pump 41A via an auxiliary magnetic valve 34.

A pilot pump 29 is connected to a pilot valve 28, and the pilot valve 28 is connected to a control lever 25. The pilot valve 28 is also connected to a pitch dump control valve 30 and a pitch back control valve 31. The pitch dump control valve 30 is connected to a pitch-tilt magnetic switching valve 32 via a left tilt limiting valve 37. The pitch back control valve 31 is connected to the pitch-tilt magnetic switching valve 32 via a right tilt limiting valve 38. An operating unit 35*a* of a first directional control valve 35 is connected to the left tilt limiting valve 37, and an operating unit 35*b* of the first directional control valve 35 is connected to the right tilt limiting valve 38. Respective operating units 36*a* and 36*b* of a second directional control valve 36 are connected to a pitch-tilt switching magnetic valve 32.

The left and right yoke angle sensors 23*a* and 23*b* are connected to a controller 50. Signals sent from the left and right yoke angle sensors 23*a* and 23*b* are entered into the controller 50, and then output signals from the controller 50 are entered into the left tilt limiting valve 37 or the right tilt limiting valve 38 according to the signals from the sensors.

Furthermore, a pitch dump switch 27 and a pitch back switch 26 are connected to the controller 50. The output signals sent from the controller 50 are entered into respective auxiliary magnetic valves 33 and 34, the pitch dump control valve 30 and the pitch back control valve 31, and the pitch-tilt switching magnetic valve 32. If the control lever 25 is operated leftwardly, the blade 10 starts a leftward tilting action. If it is operated rightwardly, the blade 10 starts a rightward tilting action.

Figure 3:
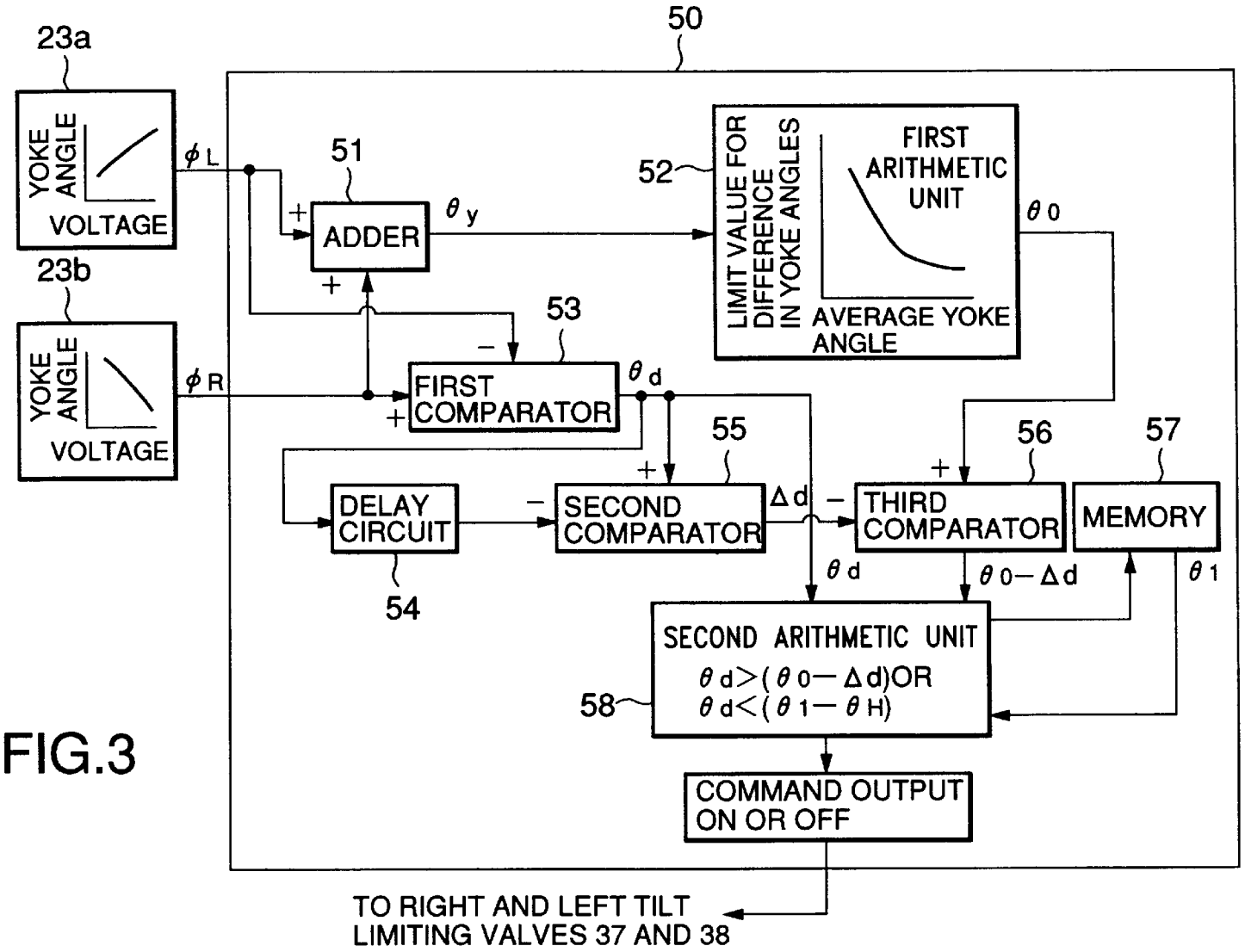
FIG. 3 is a block diagram of a control device according to the first embodiment.

Next, the details of the controller 50 will described referring to FIG. 3. Respective signals, in the form of an output voltage ØL from the left yoke angle sensor 23*a* and at an output voltage ØR from the right yoke angle sensor 23*b*, are entered into an adder 51 in the controller 50. The adder 51 enters an average yoke angle θy signal into a first arithmetic unit 52. The first arithmetic unit 52 calculates a limit value for a difference in yoke angles θ0 according to the average yoke angle θy based on a function at a predetermined tilt angle limit value, and then outputs the signals. At this point, the function in the first arithmetic unit 52 is set so that, if the average yoke angle θy in the abscissa axis is increased, the limit value for a difference in yoke angles θ0 in the ordinate axis is decreased, while if the average yoke angle θy is decreased, the limit value for a difference in yoke angles θ0 is increased. In other words, a tilt angle limit value (corresponding to the limit value for a difference in yoke angles θ0) depends on a pitch back angle (corresponding to the average yoke angle θy) of the blade 10.

On the other hand, respective signals, in the form of the output voltage ØL from the left yoke angle sensor 23*a* and the output voltage ØR from the right yoke angle sensor 23*b*, are entered into a first comparator 53 in the controller 50. The first comparator 53 enters a signal of a difference in yoke angles θd directly into a second arithmetic unit 58 and a second comparator 55, and also enters it into the second comparator 55 via a delay circuit 54. The second comparator 55 enters a signal of a correction value for a difference in yoke angles Δd into a third comparator 56, and the first arithmetic unit 52 also enters a signal of a limit value for a difference in yoke angles θ0 into the third comparator 56. The third comparator 56 outputs a difference between the signal of the limit value for a difference in yoke angles θ0 and the signal of the correction value for a difference in yoke angles Δd (θ0−Δd) to the second arithmetic unit 58.

The second arithmetic unit 58 calculates a difference θd−(θ0−Δd) between the signal of the difference in yoke angles θd from the first comparator 53 and the signal (θ0−Δd) from the third comparator 56, and if the following relation is satisfied;

$$\theta d > (\theta 0 - \Delta d)$$

it outputs a command to turn ON a solenoid of the left or right tilt limiting valve 37 or 38 so as to stop the tilting action of the blade 10. Then, the second arithmetic unit 58 transmits the signal (θ0−Δd) at this output of the command as θ1 to a memory 57 so that it is stored.

In addition, the second arithmetic unit 58 calculates a difference θd−(θ1−θH) between the signal of the difference in yoke angles θd from the first comparator and the signal θ1 read from the memory and its correction value θH (corresponding to a hysteresis loss), and if the following relation is satisfied;

$$\theta d < (\theta 1 - \theta H)$$

it outputs a command to turn OFF the solenoids of the left and right tilt limiting valves 37 and 38 so as to activate the tilting action of the blade 10.

Figure 4:
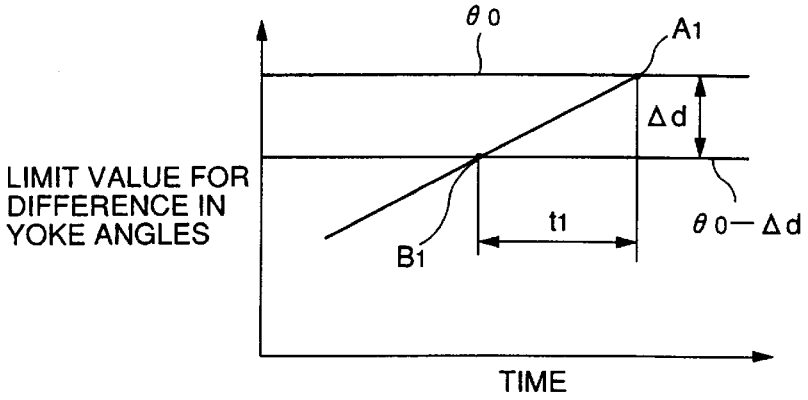
FIG. 4 is a chart showing a relationship between time and a limit value for a difference in yoke angles according to the first embodiment.

At this point, the solenoids of the left and right tilt limiting valves 37 and 38 are controlled so as to be turned ON to start the operation at a point B1 as shown in FIG. 4 and to be turned OFF to stop the tilting action of the blade 10 at a point A1 when a period of time t1 has elapsed. In other words, the blade 10 is stopped precisely within the range of the limit value for a difference in yoke angles θ0. In this embodiment, the delay time t1 is set to approximately 0.5 second, taking into consideration the response properties of the left and right tilt limiting valves 37 and 38.

Next, an explanation will be made for the left and right tilting actions of the blade 10 according to this embodiment.

If the control lever 25 is operated leftwardly as shown in FIG. 2, a pilot pressure oil from the pilot pump 29 flows into the pitch dump control valve 30. At this time, both of the pitch dump switch 27 and the pitch back switch 26 of the control lever 25 remain in the OFF state, and the pitch dump control valve 30 is in its position A and the pitch-tilt switching magnetic valve 32 is also in its position A. Therefore, the pilot pressure oil passes through the position A of the left tilt limiting valve 37 and acts on the operating unit 35*a* of the first directional control valve 35, whereby the first directional control valve 35 is switched from its neutral state to its position B.

Therefore, pressurized oil, discharged from the hydraulic pump 40A, flows into a head chamber of the first pitch cylinder 20A so as to retract the first pitch cylinder 20A. At this time, the second directional control valve 36 is put in its neutral state, so that the pressurized oil from the hydraulic pump 41A is not supplied to the second pitch cylinder 20B, whereby the second pitch cylinder 20B is put in a stop state. Accordingly, if the first pitch cylinder 20A is retracted, the blade 10 tilts leftwardly.

During the leftward tilting action of the blade 10, signals from the left and right yoke angle sensors 23*a* and 23*b* are entered into the controller 50. The controller 50 calculates the limit value for a difference in yoke angles θ0 from a predetermined function based on these signals, and then sends a signal for turning on the left tilt limiting valve 37 approximately 0.5 second before the difference reaches the limit. It switches the left tilt limiting valve 37 from its position A to its position B so as to cut off the pilot pressure oil, whereby the first directional control valve 35 returns from its position B to its neutral position. Therefore, the supplying of the pressurized oil to the first pitch cylinder 20A is stopped, and the blade 10 stops the tilting action.

If the control lever 25 is operated rightwardly, the pilot pressure oil from the pilot pump 29 flows into the pitch back control valve 31. At this time, the pitch dump switch 27 and the pitch back switch 26 are put in the OFF state, and the pitch back control valve 31 is in its position A and the pitch-tilt switching magnetic valve 32 is also in its position A. Therefore, the pilot pressure oil passes through the position A of the right tilt limiting valve 38 and acts on the operating unit 35*b* of the first directional control valve 35, whereby the first directional control valve 35 is switched from its neutral state to its position A.

Therefore, pressurized oil, discharged from the hydraulic pump 40A, flows into a bottom chamber of the first pitch cylinder 20A so as to extend the first pitch cylinder 20A. At this time, the second directional control valve 36 is put in its neutral state, so that the pressurized oil from the hydraulic pump 41A is not supplied to the second pitch cylinder 20B, whereby the second pitch cylinder 20B is put in a stop state. Accordingly, if the first pitch cylinder 20A is extended, the blade 10 tilts rightwardly.

During the rightward tilting action of the blade 10, signals from the left and right yoke angle sensors 23*a* and 23*b* are entered into the controller 50. The controller 50 calculates the limit value for a difference in yoke angles θ0 from a predetermined function based on these signals, and then sends a signal for turning on the right tilt limiting valve 38 approximately 0.5 second before the difference reaches the limit. It switches the right tilt limiting valve 38 to its position B so as to cut off the pilot pressure oil, whereby the first directional control valve 35 returns from its position A to its neutral position. Therefore, the supplying of the pressurized oil to the first pitch cylinder 20A is stopped and the blade 10 stops the tilting action.

Now, an explanation will be made for the pitch back and pitch dump actions of the blade 10 according to this embodiment.

During the pitch back or pitch dump action, a command signal from the controller 50 is not entered into the left and right tilt limiting valves 37 and 38, and both of them are put in their position A (open position).

If the pitch back switch 26 of the control lever 25 is set to ON, the pitch back control valve 31 and the pitch-tilt switching magnetic valve 32 are switched from the position A to their position B, and a command signal from the controller 50 is entered to the auxiliary magnetic valves 33 and 34, whereby the auxiliary magnetic valves 33 and 34 are also switched from their position A to their position B. Therefore, flows of discharge from respective auxiliary hydraulic pumps 40B and 41B join discharge flows of respective hydraulic pumps 40A and 41A.

At this time, the pilot pressure oil from the pilot pump 29 is supplied from the position B of the pitch back control valve 31 to the operating unit 36*b* of the second directional control valve 36 via the pitch-tilt switching magnetic valve 32 and also supplied from the position B of the pitch back control valve 31 to the operating unit 35*b* of the first directional control valve 35. Accordingly, the first directional control valve 35 and the second directional control valve 36 are switched from their neutral state to their position A; the pressurized oil, discharged from the hydraulic pump 40A, passes through the first directional control valve 35 and flows into the bottom chamber of the first cylinder 20A; and the pressurized oil, discharged from the hydraulic pump 41A, passes through the second directional control valve 36 and flows into the bottom chamber of the second cylinder 20B. Therefore, the first cylinder 20A and the second cylinder 20B extend simultaneously, so that the blade 10 quickly performs a pitch dump action.

In addition, if the pitch dump switch 27 of the control lever 25 is set to ON, the pitch dump control valve 30 and the pitch-tilt switching magnetic valve 32 are switched from their position A to their position B, and a command signal from the controller 50 is entered into the auxiliary magnetic valves 33 and 34, whereby the auxiliary magnetic valves 33 and 34 are switched from their position A to their position B. Therefore, flows of discharge from the auxiliary hydraulic pumps 40B and 41B join the discharge flows of the hydraulic pumps 40A and 41A.

At this time, the pilot pressure oil from the pilot pump 29 is supplied from the position B of the pitch dump control valve 30 to the operating unit 36*a* of the second directional control valve 36 via the pitch-tilt switching magnetic valve 32 and also supplied from the position B of the pitch dump control valve 30 to the operating unit 35*a* of the first directional control valve 35. Accordingly, the first directional control valve 35 and the second directional control valve 36 are switched from their neutral state to their position B; the pressurized oil, discharged from the hydraulic pump 40A, passes through the first directional control valve 35 and flows into the head chamber of the first cylinder 20A; and the pressurized oil, discharged from the hydraulic pump 41A, passes through the second directional control valve 36 and flows into the head chamber of the second cylinder 20B. Therefore, the first cylinder 20A and the second cylinder 20B extend simultaneously, so that the blade 10 quickly performs a pitch back action.

Figure 5:
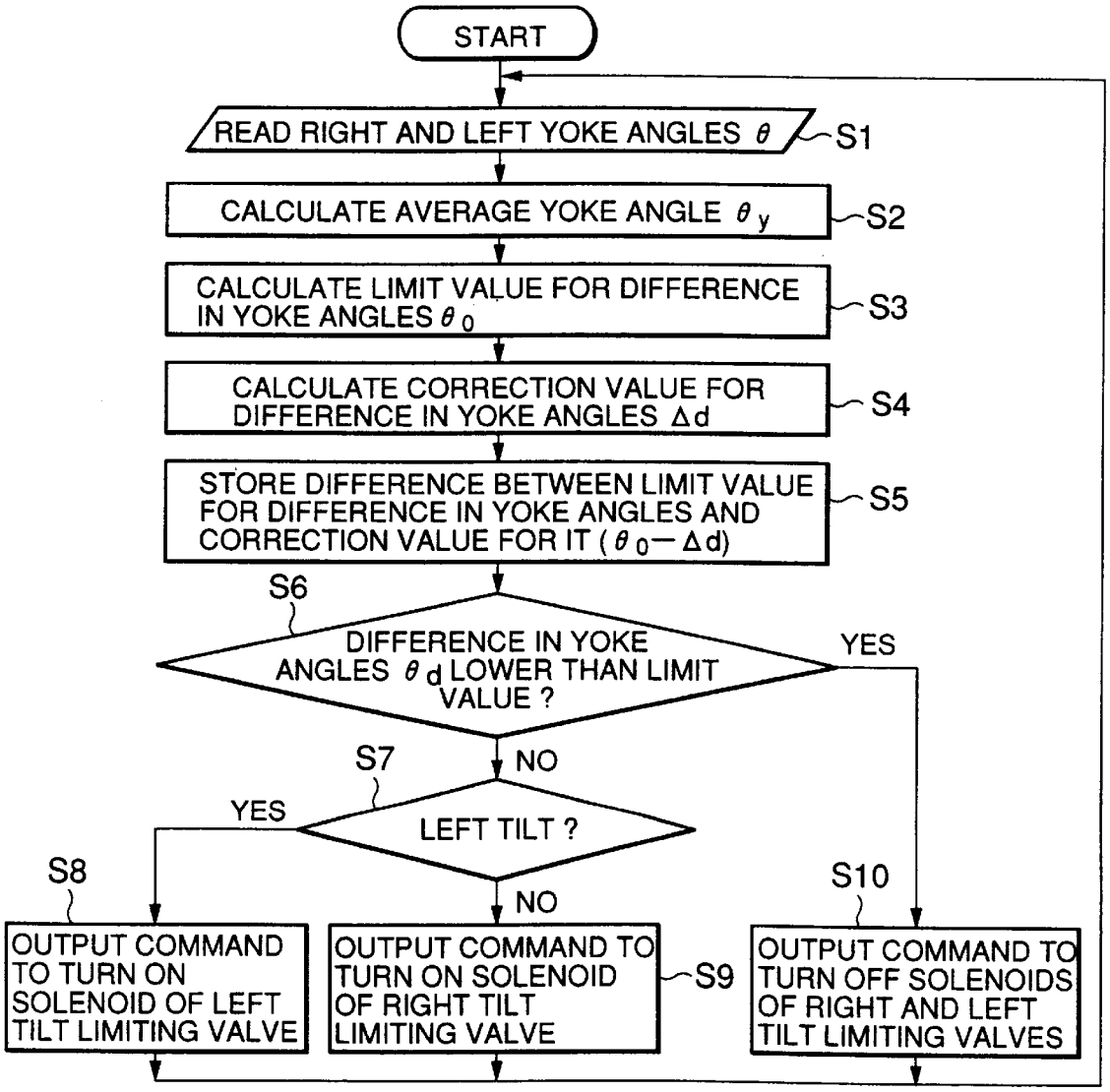
FIG. 5 is a blade control flowchart according to the first embodiment.
Figure 6:
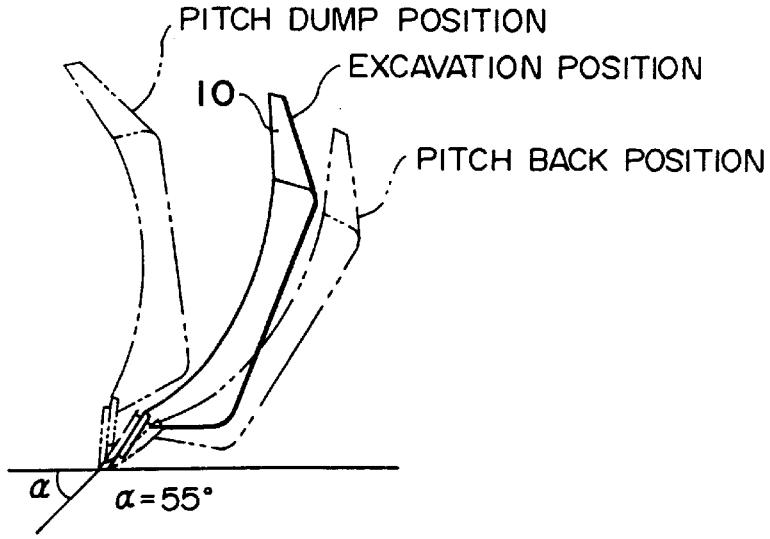
FIG. 6 is a description diagram showing a excavation position, a pitch dump position, and a pitch back position of a blade.
Figure 7A:
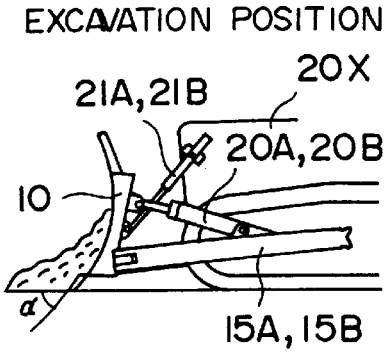
FIGS. 7A, 7B, and 7C are description diagrams of working states of the bulldozer in the respective positions of FIG. 6.
Figure 7B:
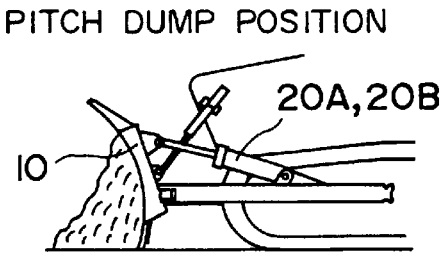
Figure 7C:
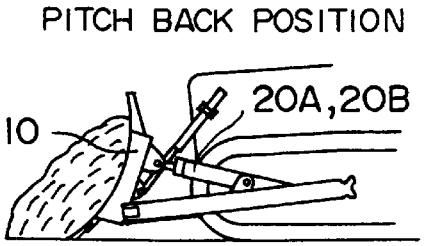
Figure 8:
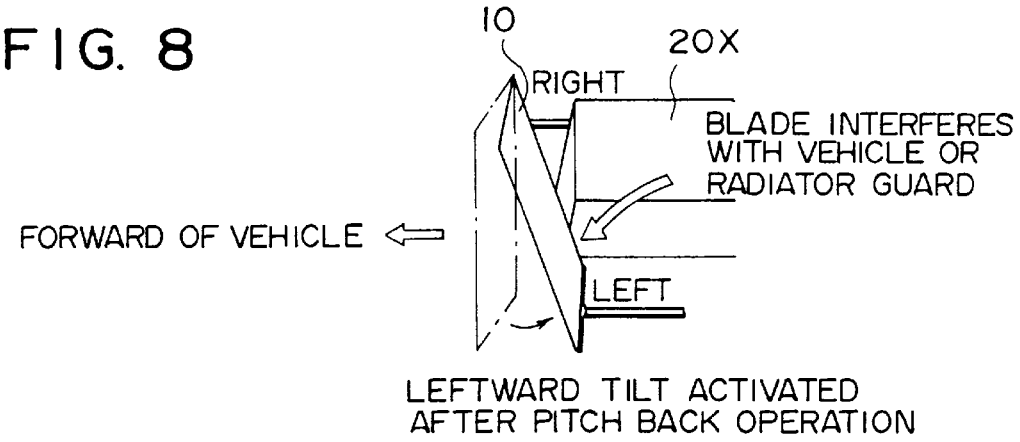
FIG. 8 is a description diagram of an interference condition between the blade of the bulldozer and a radiator guard.
Figure 10A:
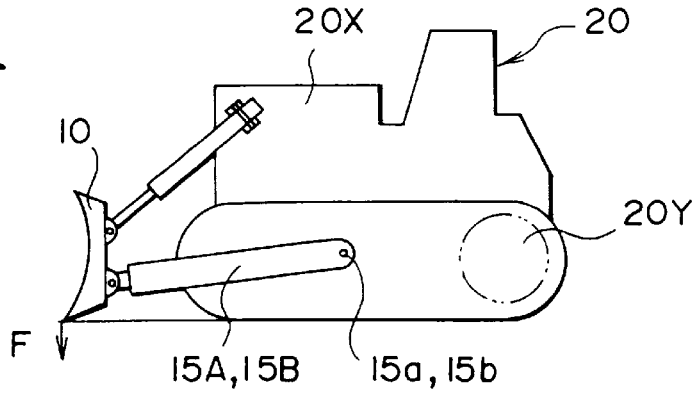
FIG. 10A PRIOR ART
FIG. 10A is a description diagram of a nose force of a conventional bulldozer.
Figure 10B:
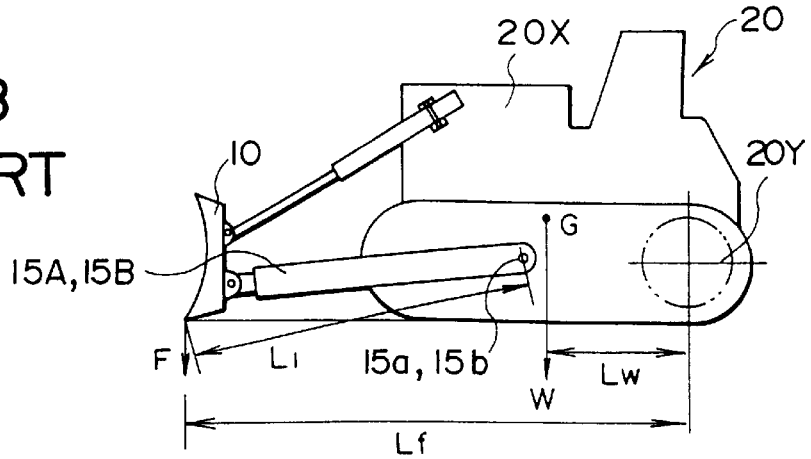
FIG. 10B PRIOR ART
FIG. 10B is a description diagram of a nose force of another type of a conventional bulldozer.

Next, a blade control method of this embodiment will be described below by using a flowchart shown in FIG. 5.

First, left and right yoke angles θ are detected by the left and right yoke angle sensors 23*a* and 23*b* in step S1. In step S2, an average yoke angle θy between the left and right yoke angles is calculated.

In step S3, a limit value for a difference in yoke angles θ0 is calculated from the average yoke angle θy based on a predetermined function. In step S4, a correction value (or a rate of change) for a difference in yoke angles Δd is calculated. In step S5, θ1 is assumed to be a difference (θ0−Δd) between a limit value for a difference in yoke angles θ0 and a correction value for the difference in yoke angles Δd obtained when the solenoids of the left and right tilt limiting valves 37 and 38 are turned ON in step S5 and then the signal is stored in the memory 57.

In step S6, it is determined whether or not a difference in yoke angles θd is lower than the limit value. If the difference in yoke angles θd is equal to or greater than the limit value, the control proceeds to step S7 to determine whether or not the tilt is leftward. if the tilt is leftward, the control proceeds to step S8, so that the controller 50 outputs a command signal so as to turn ON the solenoid of the left tilt limiting valve 37. Unless the tilt is leftward, the control proceeds to step S9, so that the controller 50 outputs a comimand signal so as to turn ON the solenoid of the right tilt limiting valve 38. Then, the control returns to step S1.

If the difference in yoke angles θd is lower than the limit value in step S6, the control proceeds to step S10, so that the controller 50 outputs a command signal so as to turn OFF the solenoids of the left and right tilt limiting valves 37 and 38. Then, the control returns to step S1.

As set forth hereinabove, the average yoke angle θy is obtained from the left and right yoke angles θ and the limit value for a difference in yoke angles θ0 is calculated based on a predetermined function; if the difference in yoke angles θd is equal to or greater than the limit value, the solenoids of the left and right tilt limiting valves 37 and 38 are automatically turned ON so as to stop the tilt action of the blade 10 precisely to prevent the blade 10 from interfering with the vehicle body 20*x* or the like.

While this embodiment has been explained for the tilting operation of the blade 10 in the above, it will be understood that the embodiment is also applicable to the lift operation and the pitch back operation of the blade.

Figure 9A:
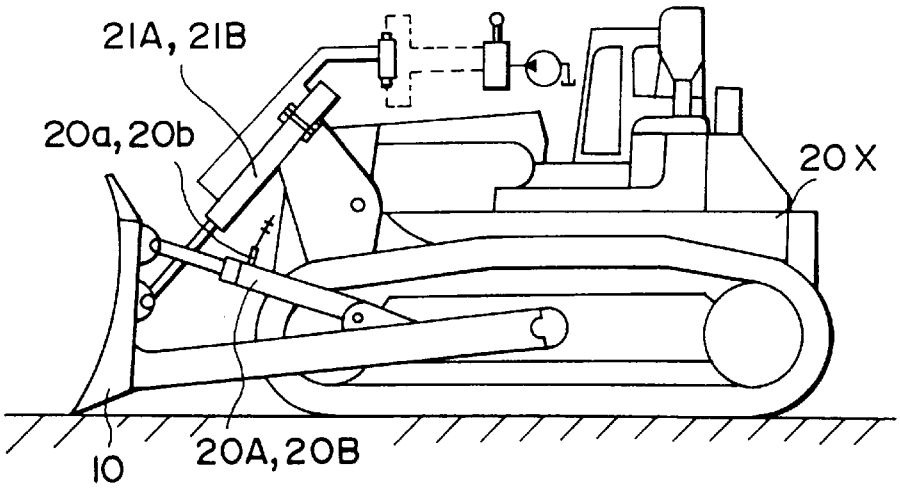
FIG. 9A is a side view of the bulldozer according to a second embodiment of the present invention.
Figure 9B:
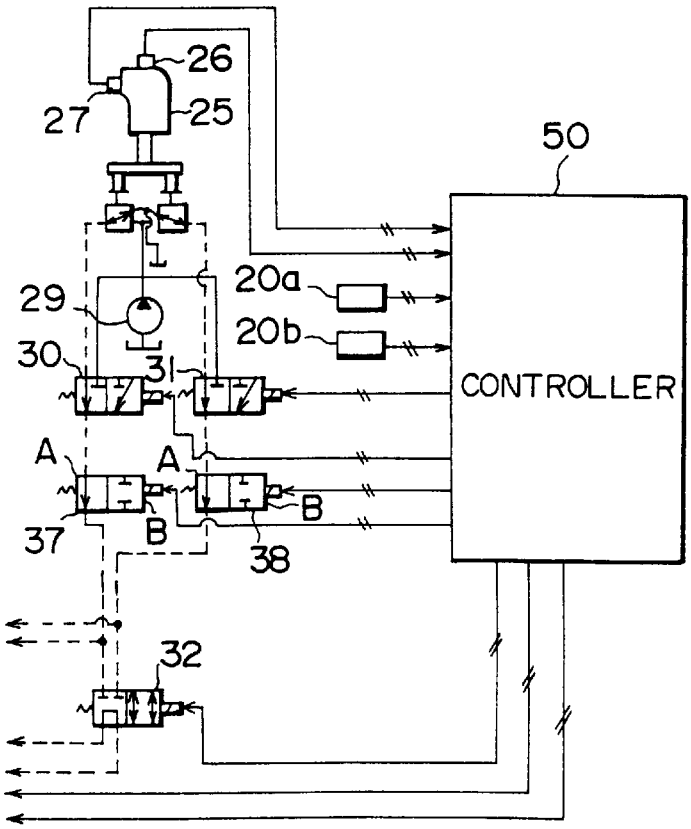
FIG. 9B is a segmentary view of a blade control circuit according to the second embodiment.

Next, a second embodiment of the present invention will be explained below with reference to FIGS. 9A and 9B. In this embodiment, instead of the yoke angle sensors 23*a* and 23*b* installed on opposite sides of the vehicle body 20*x* in the first embodiment, stroke sensors 20*a* and 20*b* for detecting working strokes are installed in the left and right pitch cylinders 20A and 20B for actuating a tilting action of the blade 10. An explanation of other configurations is omitted here except that the reference numerals are shown in the drawings since they are the same as for the first embodiment.

The stroke sensors 20*a* and 20*b* detect the working strokes of the left and right pitch cylinders 20A and 20B, and then the signals are entered into the controller 50. The controller 50 obtains an average stroke value from the signals and then calculates a limit value for a difference in strokes. If the difference in working strokes is equal to or greater than the limit value, solenoids of the left and right tilt limiting valves 37 and 38 are automatically turned ON so as to stop the tilting action of the blade 10 precisely to prevent the blade from interfering with the vehicle body 20*x* or the like.

According to the first and second embodiments, interference of the blade 10 of the bulldozer with the vehicle body 20*x* or the like is prevented, so that the blade does not damage them. In addition, an operator can safely control the blade 10, and therefore he feels less fatigue, which improves the workability.

INDUSTRIAL APPLICABILITY

The present invention is useful as a blade control device and its control method, by which interference between a blade of a bulldozer and a vehicle body can be prevented by an automatic control of precisely stopping a tilting action of the blade when a difference between amounts of tilt reaches a predetermined limit value, even when a pitch back angle of the blade is made large and a tilt speed is increased to greatly change a tilt angle.

What is claimed is:

1. A method for controlling a blade of a bulldozer, said method comprising the steps of:

controlling movement of the blade upwardly and downwardly by driving of left and right hydraulic lift cylinders;

controlling pitch of the blade with pitch dump and pitch back actions by supplying pressurized oil to left and right hydraulic pitch cylinders via first and second directional control valves during driving of said left and right hydraulic pitch cylinders;

controlling tilt of the blade with left and right tilting actions by supplying pressurized oil to one of the left and right hydraulic pitch cylinders via one of the first and second directional control valves;

detecting respective amounts of leftward and rightward tilt when said blade is tilted rightward or leftward; and automatically stopping the tilting action of said blade when a difference between the thus detected amounts of leftward and rightward tilt reaches a predetermined limit value to prevent interference between the blade and the bulldozer.

2. A method in accordance with claim 1, wherein said step of detecting respective amounts of leftward and rightward tilt comprises detecting respective rotational angles of left and right yokes supporting said left and right hydraulic lift cylinders, respectively; and wherein said step of stopping comprises:

calculating a limit value for a difference between thus detected rotational angles based on an average yoke angle of the detected rotational angles; and when the difference between thus detected left and right rotational angles reaches the thus calculated limit value, automatically turning ON left and right tilt limiting valves so as to stop the tilting action of said blade.

3. A method in accordance with claim 1, wherein said step of detecting respective amounts of leftward and rightward tilt comprises detecting a working stroke of said left hydraulic pitch cylinder and detecting a working stroke of said right hydraulic pitch cylinder; and wherein said step of stopping comprises:

calculating a limit value for a difference between thus detected working strokes, based on an average working stroke of the thus detected working strokes; and when the difference between thus detected left and right working strokes angles reaches the thus calculated limit value, automatically turning ON left and right tilt limiting valves so as to stop the tilting action of said blade.

4. A method in accordance with claim 1, wherein the step of stopping the tilting action of said blade is initiated a certain period of time before the difference between the amounts of leftward and rightward tilt reaches the predetermined limit value.

5. A method in accordance with claim 4, wherein said step of detecting respective amounts of leftward and rightward tilt comprises detecting respective rotational angles of left and right yokes supporting said left and right hydraulic lift cylinders, respectively; and wherein said step of stopping comprises:

calculating a limit value for a difference between thus detected rotational angles based on an average yoke angle of the detected rotational angles; and when the difference between thus detected left and right rotational angles reaches the thus calculated limit value, automatically turning ON left and right tilt limiting valves so as to stop the tilting action of said blade.

6. A method in accordance with claim 4, wherein said step of detecting respective amounts of leftward and rightward tilt comprises detecting a working stroke of said left hydraulic pitch cylinder and detecting a working stroke of said right hydraulic pitch cylinder; and wherein said step of stopping comprises:

calculating a limit value for a difference between thus detected working strokes, based on an average working stroke of the thus detected working strokes; and when the difference between thus detected left and right working strokes angles reaches the thus calculated limit value, automatically turning ON left and right tilt limiting valves so as to stop the tilting action of said blade.

7. A bulldozer comprising:

a vehicle body;

a left frame having a front end and a rear end with the rear end of said left frame being pivotally mounted to a left side of said vehicle body;

a right frame having a front end and a rear end with the rear end of said right frame being pivotally mounted to a right side of said vehicle body;

a blade pivotally mounted to each of the front ends of said left frame and said right frame so as to permit pivoting of said blade in a forward direction and in a backward direction;

a left hydraulic lift cylinder and a right hydraulic lift cylinder for controlling movement of the blade upwardly and downwardly, each of said left hydraulic lift cylinder and said right hydraulic lift cylinder having a first end and a second end, the first end of each of said left hydraulic lift cylinder and said right hydraulic lift cylinder being removably and pivotally installed to the blade, the second end of each of said left hydraulic lift cylinder and said right hydraulic lift cylinder being pivotally mounted to said vehicle body;

a first directional control valve having operating units for operating said first directional control valve;

a second directional control valve having operating units for operating said second directional control valve;

a left hydraulic pitch cylinder and a right hydraulic pitch cylinder for controlling pitch of the blade with pitch dump or pitch back actions via said first directional control valve and said second directional control valve and for controlling the blade with left and right tilt actions via one of said first and second directional control valves, each of said left hydraulic pitch cylinder and said right hydraulic pitch cylinder having a first end and a second end, the first end of each of said left hydraulic pitch cylinder and said right hydraulic pitch cylinder being removably and pivotally installed to the blade, the second end of each of said left hydraulic pitch cylinder and said right hydraulic pitch cylinder being removably and pivotally installed to a respective one of said left frame and said right frame;

a left detector for detecting an amount of tilt of said blade;

a right detector for detecting an amount of tilt of said blade;

a left tilt limiting valve and a right tilt limiting valve connected to operations units of said first and second directional control valves; and a controller for outputting a command to the left and right tilt limiting valves so as to stop a tilting action of said blade when a difference between amounts of tilt detected by said left detector and said right detector reaches a predetermined limit value selected to prevent interference between the blade and the vehicle body.

8. A bulldozer in accordance with claim 7, wherein the second end of said left hydraulic lift cylinder is pivotably mounted to said vehicle body via a left yoke;

wherein the second end of said right hydraulic lift cylinder is pivotably mounted to said vehicle body via a right yoke;

wherein said left detector is a yoke angle sensor for detecting a rotational angle of said left yoke; and wherein said right detector is a yoke angle sensor for detecting a rotational angle of said right yoke.

9. A bulldozer in accordance with claim 7, wherein said left detector is a stroke sensor for detecting a working stroke of said left hydraulic pitch cylinder; and wherein said right detector is a stroke sensor for detecting a working stroke of said right hydraulic pitch cylinder.

10. A bulldozer in accordance with claim 7, wherein said controller is equipped with a delay circuit for calculating a correction value used for initiating a stopping of the tilting action of the blade a certain period of time before the difference between amounts of tilt detected by said left and right detectors reaches the predetermined limit value.

11. A bulldozer in accordance with claim 10, wherein the second end of said left hydraulic lift cylinder is pivotably mounted to said vehicle body via a left yoke;

wherein the second end of said right hydraulic lift cylinder is pivotably mounted to said vehicle body via a right yoke;

wherein said left detector is a yoke angle sensor for detecting a rotational angle of said left yoke; and wherein said right detector is a yoke angle sensor for detecting a rotational angle of said right yoke.

12. A bulldozer in accordance with claim 10, wherein said left detector is a stroke sensor for detecting a working stroke of said left hydraulic pitch cylinder; and wherein said right detector is a stroke sensor for detecting a working stroke of said right hydraulic pitch cylinder.

* * * * *